US005404421A

United States Patent [19]

Wallace et al.

[11] Patent Number: 5,404,421

[45] Date of Patent: Apr. 4, 1995

[54] FUEL HEATING ELEMENT MOUNTING PLUG HOUSING A THERMOSTAT

[75] Inventors: Louis Wallace, Columbus, Miss.; Randall Markum, Vernon, Ala.

[73] Assignee: Emerson Electric Co., St. Louis, Mo.

[21] Appl. No.: 9,931

[22] Filed: Jan. 27, 1993

[51] Int. Cl.[6] ..... H05B 3/78; F24H 1/20

[52] U.S. Cl. ..... 392/455; 392/454; 392/498

[58] Field of Search ..... 219/437; 337/365, 380; 392/449–457, 497–501

[56] References Cited

U.S. PATENT DOCUMENTS

| | | | |
|---|---|---|---|
| 1,715,687 | 6/1929 | Vaughan | 392/498 X |
| 1,892,557 | 12/1932 | McCormick | 392/454 |
| 1,984,076 | 12/1934 | Munnot | 392/498 X |
| 1,996,634 | 4/1935 | Vaughan | 392/454 |
| 2,039,030 | 4/1936 | Reifenberg | 392/454 X |
| 2,446,555 | 8/1948 | Sage | 392/501 X |
| 3,381,100 | 4/1968 | Lee | 392/454 |
| 3,497,677 | 2/1970 | Blain | 392/498 X |
| 4,091,354 | 5/1978 | Deubel et al. | 337/365 |
| 4,360,726 | 11/1982 | Haden | 392/497 X |

FOREIGN PATENT DOCUMENTS

| | | | |
|---|---|---|---|
| 663368 | 12/1951 | United Kingdom | 392/498 |
| 744181 | 2/1956 | United Kingdom | 392/498 |
| 799096 | 7/1958 | United Kingdom | 392/451 |
| 807556 | 1/1959 | United Kingdom | 392/498 |
| 849661 | 9/1960 | United Kingdom | 392/498 |
| 858953 | 1/1961 | United Kingdom | 392/498 |
| 1007156 | 10/1965 | United Kingdom | 392/498 |
| 1049874 | 11/1966 | United Kingdom | 392/498 |
| 1097193 | 12/1967 | United Kingdom | 392/498 |
| 1332641 | 10/1973 | United Kingdom | 392/498 |

*Primary Examiner*—John A. Jeffery

*Attorney, Agent, or Firm*—Polster, Lieder, Woodruff & Lucchesi

[57] ABSTRACT

A combined heating element and thermostat for use in a water heater. An electrical heating element includes a U-shaped rod having first and second legs, the first leg being longer than the second. A plug fits in a sidewall of the heater. The rod is installed in the plug. The outer end of the legs are inserted in the plug. A thermostat is also mounted in the plug. An electrical terminal is attached to the plug and includes a first terminal contacting the outer end of the first leg of the rod. A second terminal contacts the other leg of the rod. A switch connects and disconnects the second terminal with the second leg of the rod. The switch is movable by the thermostat and includes a bumper element. The thermostat moves the bumper to disconnect the rod leg from the terminal when the water is heated to a desired temperature.

6 Claims, 3 Drawing Sheets

FUEL HEATING ELEMENT MOUNTING PLUG HOUSING A THERMOSTAT

BACKGROUND OF THE INVENTION

This invention relates to heating elements for water heaters and the like and, more particularly, to a combination heating element and sensor to provide a more reliable and energy efficient water heater.

The average electric storage water heater uses two heating elements. One of these is located in the upper part of the tank adjacent an upper port, and the other is located in the bottom portion of the tank adjacent a lower port. The heater also employs two thermostats independently mounted to a wall of the tank, usually directly above each of the respective heating elements, to sense the water temperature in the respective portions of the tank. The thermostats comprise bimetallic discs which are in contact with an outer wall of the tank. These thermostats are typically adjustable to a temperature setting of between 100° F. (38° C.) and 170° F. (77° C.). During a normal heat cycle, application of voltage to the individual heating elements is controlled by its associated thermostat for example, as the preselected water temperature is reached at an upper part of the tank, the bimetallic disc opens. This interrupts the circuit to the upper heating element. The lower heating element, which is separately powered continues to operate.

while the above set-up may operate satisfactory, the arrangement requires a number of different components. As such, the arrangement is costly and inefficient. A different configuration of heating elements and thermostats could reduce electricity usage and increase efficiency. In addition, there is also need for a more reliable thermostat which would also help improve efficiency.

SUMMARY OF THE INVENTION

Among the several objects of the present invention may be noted the provision of a heating element for use in water heaters to heat the water to a desired temperature; the provision of a thermostat which is adjustable to set the desired temperature; the provision of such a heating element and thermostat which is combined into a single unit for easier installation and removal; the provision of such an integral combination to be more energy efficient than for both elements operating separately; the provision of such an integral combination to function as well as the elements when used separately; the provision of such an integral combination to be incorporated in a screw plug or the like which is insertable in the side of the water heater with the thermostat sensing water temperature by heat conduction through the screw plug; the provision of such a combination in which two units are employed, one at the upper portion and one at the bottom portion of the water heater; and, the provision of such a combination in which sensing of the water temperature reaching the desired temperature by the thermostat in one unit interrupts operation of that unit and initiates operation of the other unit.

In accordance with the invention, generally stated, a combination heating element and thermostat is for use in a water heater. An electrical heating element is used to heat water in the water heater. A thermostat senses the water temperature. The thermostat controls an electrical circuit which powers the heating element. The thermostat stops operation of the heating element when a desired water temperature in the heater has been reached. The heating element and thermostat are commonly mounted in a screw plug which is installable in a sidewall of the heater. The heating element is installed in the screw plug so to be in contact with the water to heat the water. The thermostat is installed in the screw plug so as to not be in contact with the water. The screw plug is thermally conductive and the thermostat is in a heat transfer relationship with the screw plug to sense water temperature by the thermal conduction of the screw plug. A temperature control system and a method of temperature control are also disclosed. In the temperature control system, two combined units are used. One of the units includes a switching element which is responsive to the temperature being reached to open an electrical circuit by which electricity is delivered to the heating element in that unit; while simultaneously closing a circuit so electricity is supplied to the heating element in the other unit. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
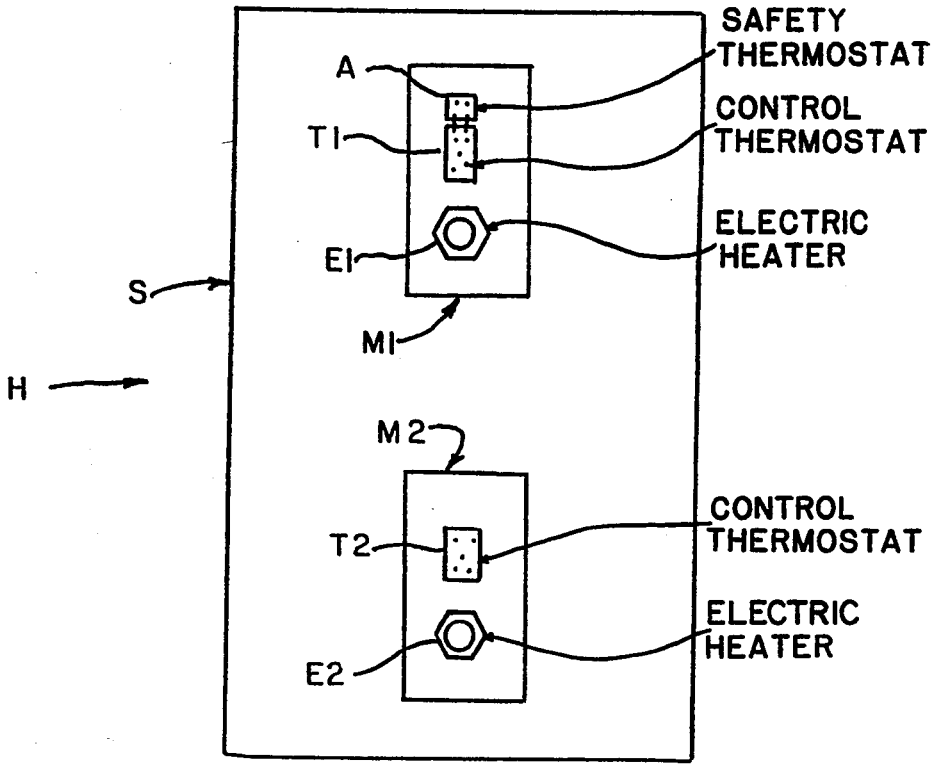
FIG. 1 PRIOR ART
FIG. 1 is a representation of a prior art water heater in which separate water heating elements and thermostats are used to control water temperature.

Referring to the drawings, a water heater H includes a shell S, a portion of which is shown in FIG. 1. The shell defines a tank or chamber in which water is heated for home or commercial use. Water in the tank is typically heated to a temperature of between 100° F. (38° C.) and 170° F. (77° C.). For this purpose, two heating elements, E1 and E2 respectively, are used. Element E1 is located in the upper portion of the tank, and element E2 in the lower portion. Each heating element has an associated thermostat, T1 and T2, respectively. These thermostats are separately installed and are used to monitor the the water temperature in the respective portion of the tank. As shown in FIG. 1, the thermostats are installed adjacent to their associated heating elements. Additionally, an over-temperature switch A is mounted to the tank wall adjacent to thermostat T1. Switch A is controlled by thermostat T1 to control flow of electricity to the heating elements. Usually this is the upper heating element. In operation, the user of the heated water selects a desired water temperature using the upper heating element El. When the thermostats sense that this temperature has been reached, the upper heating element is shut off. The lower heating element E2 is then switched on and keeps the water temperature at the desired level. If the water temperature drops off due to use of hot water, and its replacement in the tank with water at a lower temperature, electricity is re-supplied to heating element E1 to help heat the water back to the selected temperature. Heating element E2 is switched off at that time.

The arrangement of FIG. 1 requires five separate pieces to be installed in the sidewall of the water tank. The three upper pieces, and the two lower pieces, are respectively mounted in a mounting plate M1 or M2 provided for that purpose. The switch element A and thermostat T1 further have to connect together to provide the circuit breaker capability needed to interrupt electricity to heating element E1.

Figure 2:
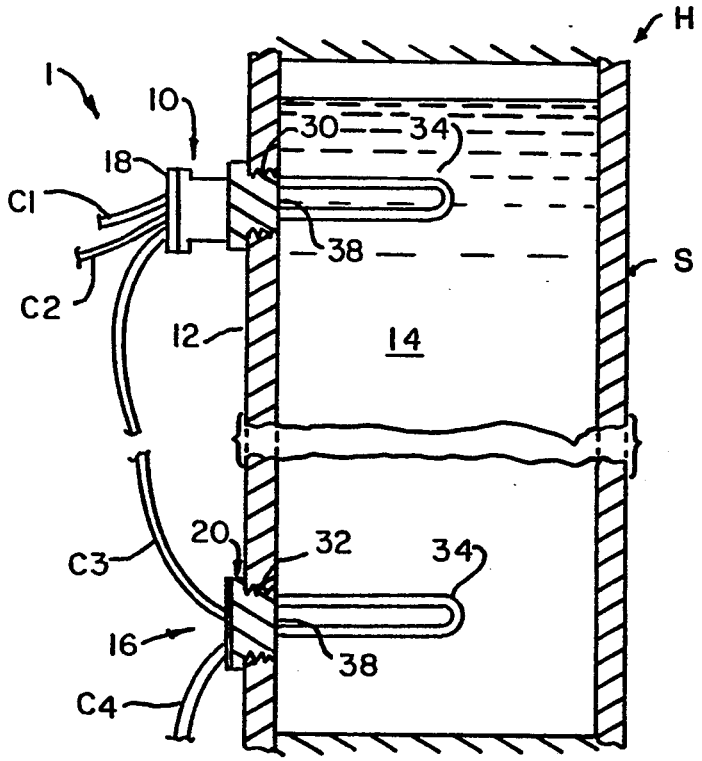
FIG. 2 is a schematic sectional view of a water heater in which the combination of the present invention is used.

Referring to FIG. 2, the present invention is indicated generally 1 and includes a combined heating element and thermostat unit 10, 16 for use with the water heater. The first unit 10 is shown mounted in the upper portion of the sidewall 12 of a water heating chamber 14; and, a second unit 16 is shown mounted in the lower portion of the sidewall. Both unit 10 and unit 16 include a terminal block 18, 20, respectively for supplying electrical power to the heating element included in the unit. Further, unit 10 includes a switch means 22 (see FIGS. 9A, 9B and 10) for performing the switching function referred to above.

Figure 3:
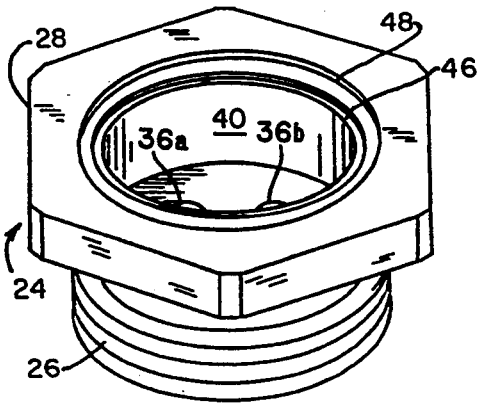
FIG. 3 is a perspective view of a screw plug used in the combination.
Figure 4:
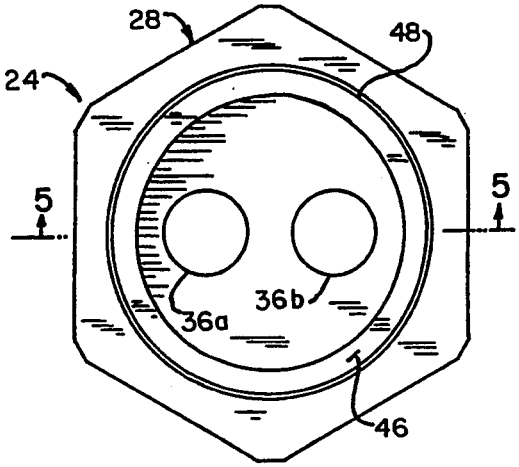
FIG. 4 is an elevational view of the screw plug.
Figure 5:
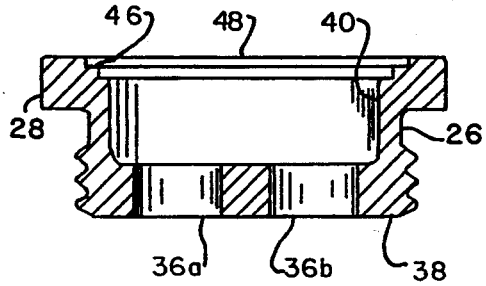
FIG. 5 is a sectional view of the screw plug taken along line 5—5 in FIG. 4.

As shown in FIGS. 3–5, each unit 10 and 16 has a screw plug 24 having a shank portion 26 and a flanged end 28. Shank 26 comprises a hollow, cylindrical shank which is exteriorally threaded. This allows the screw plug to be installed in a threaded bore 30, 32 in the respective upper and lower portions of the heater sidewall. A heating element for use in the combination includes a U-shaped heating rod 34. For reasons described hereinafter, heating rod 34 has one leg **34*a* longer than its other leg 34*b*. Spaced openings 36*a*, 36*b* are formed in the outer "wet" end 38 of the shank. The ends of the rod extend into bore 40** of the shank through these openings. When the screw plug is installed in the sidewall, the heating rod protrudes into the tank.

Each thermostat includes a bi-metallic disc 42 the diameter of which corresponds to the diameter of bore 40 for the disc to be inserted in the bore. The the disc is inserted in the bore so to be positioned at the inward end of the bore. Accordingly, it is in thermal contact with the water being heated, by conduction of heat through end wall 38 of the plug. The disc has spaced holes **44*a*, 44*b* whose diameter is slightly larger than the diameter of the legs of the heating element. Thus, the legs of the heating rod extend through the disc when it is in place. Finally, as a bi-metallic disc, disc 42 flexes (deforms) in a specific direction when a particular temperature is reached. For use in units 10 and 16**, the disc is oriented in the plug so it lows outwardly when the temperature is reached (see FIG. 9B).

Figure 6:
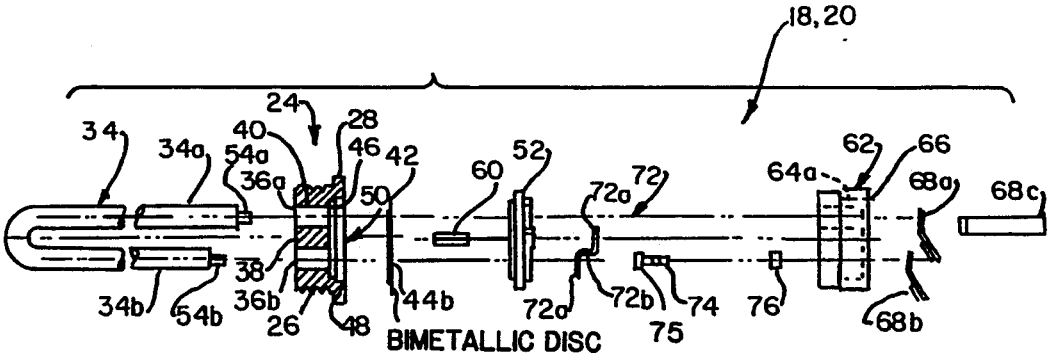
FIG. 6 is an exploded view of the assembly.
Figure 7:
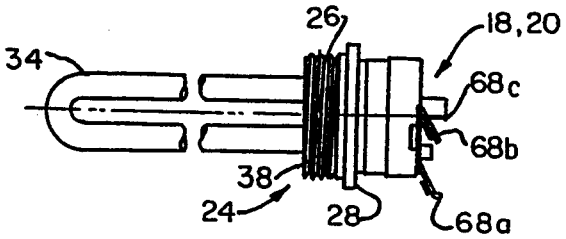
FIG. 7 is a side elevational view of the assembly.
Figure 8:
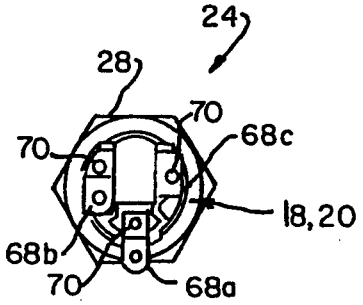
FIG. 8 is a rear view of the assembly.

Terminal blocks 18 and 20, while electrically different, are physically of the same size and shape. Each terminal block is designed to fit in the open end of the screw plug at the open, rear end of bore 40. An annular groove 46 is formed at the outer end of bore 40, at the rear of the plug. A second and larger diameter annular groove 48 is formed rearwardly of groove 46. Together grooves 46 and 48 form a seat for a socket ring 52 of the terminal block. As shown in FIG. 6, the ends of legs **34*a*, 34*b* have reduced diameter end sections 54*a*, 54*b*, respectively. These sections fit into respective openings 56*a*, 56*b* formed in ring 50. End 54*b*, the inner end of the shorter leg of the heating rod, terminates at the outer end of the socket ring. The longer leg 34*a*** of the heating rod extends through the ring and beyond.

In addition to openings **56*a*, 56*b*, ring 50 further includes a central longitudinally extending bore 58. This is because the heating rod/thermostat combination 10 also includes a bumper rod 60 installed in bore 40 of screw plug 24. The bumper rod is installed in the bore to extend longitudinally thereof. One end of the rod rests against the outer face of bi-metallic disc 42. The other end of the rod extends into the terminal block through bore 48. Again referring to FIG. 6, the terminal block includes a cap 62 which fits onto socket ring 52. The terminal block is hollow, and the end of the longer leg 34*a* of the heating element extends through the cap. The cap has openings 64*a*, 64*b* in its base 66 and the smaller diameter end of leg 34*a* fits through opening 64*a***.

To electrically connect the heating rod in a circuit so it can heat the water in the tank, a pair of electrical terminals **68*a*, 68*b* are attached to the rear face of the terminal 62. Each cap is attached to base 66 by a rivet 70 or similar attachment. Both terminals have a flat section for electrical connection with a terminal 54*a* or 54*b* of the heating rod, and an angled section which extends outwardly from the base of the cap. The connector end of an electrical conductor C1 or C2 fits over this angled end of the terminal. Because end 54*a* of the heating rod extends completely through the terminal block, the rear face of the end physically and electrically contacts terminal 68*a*. For electrically connecting end 54*b* of the heating rod with terminal 68*a*, a movably mounted electrical 72 is installed on the outer face of the socket ring 52. This contact is a Z-shaped contact and the contact comprises the switch means 22 referred to above. The contact has a flat outer face 72*a* against which end 34*b* of the heating rod bears. It also has a center section 72*b* which extends rearwardly of the socket ring toward the cap piece. Finally, it has an inner flat surface 72*c* which is positioned over, but spaced apart from the end of the bumper rod 60 extending through bore 58** in the socket ring.

Figure 9A:
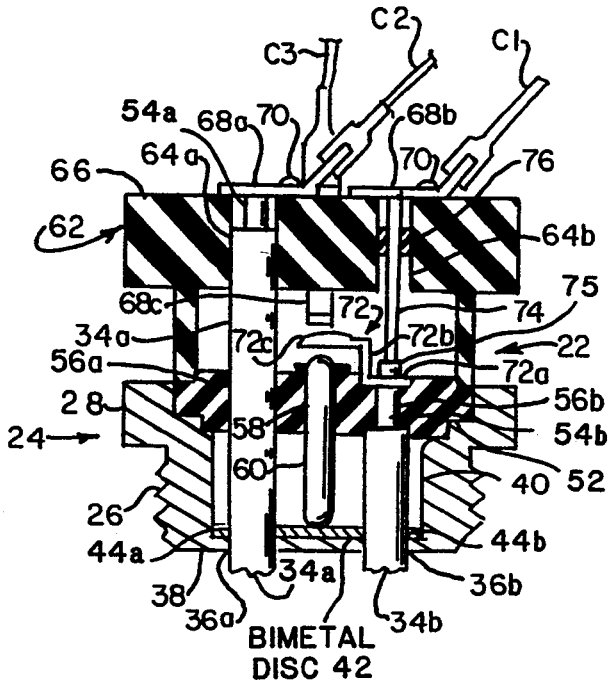
FIG. 9A is a sectional view of the screw plug assembly prior to the water temperature reaching the desired temperature.

Referring to FIG. 9A, when the water is first being heated, current is supplied through heating element 34 in unit 10. At that time, current flow is through conductor C1, and terminal **68*b*, to end 54*b* of the rod. From terminal 68*b* current flows through rod 34 to end 34*b* of the rod 74. Rod 74 is reciprocally movable through a guide sleeve 76 installed in opening 64*b* in the terminal block. The rod 74 has an enlarged head 75 which engages portion 72*a* of contact 72. The outer end of this electrically conductive rod bears against terminal 68*b*. Current also flows from conductor C2 through terminal 68*a* to the end 54*a* of the heating rod 34. This completes the circuit path from conductor C1 to conductor C2. Terminal 68*b* exerts a spring force on rod 74 to keep face 72*a* of movable contact 72 in electrical contact with end 54*b* of heating rod 34**.

Figure 9B:
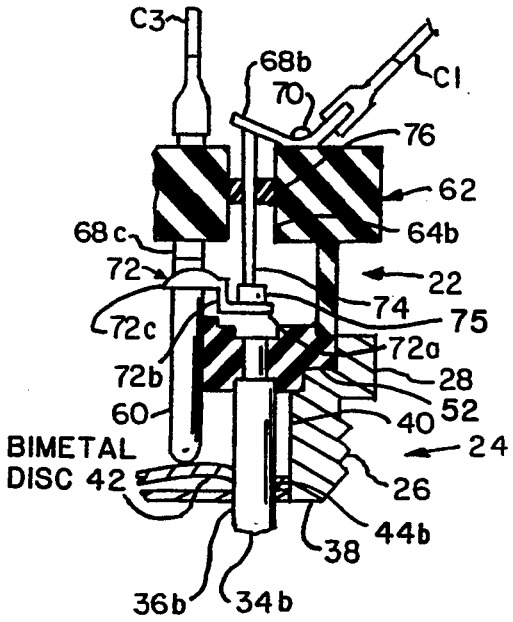
FIG. 9B is a modified sectional view illustrating the switching action which occurs when the desired temperature is reached; and, FIG. 10 is a schematic circuit diagram of the electrical circuit connections through heating elements in the two units used with the water heater.
Figure 10:
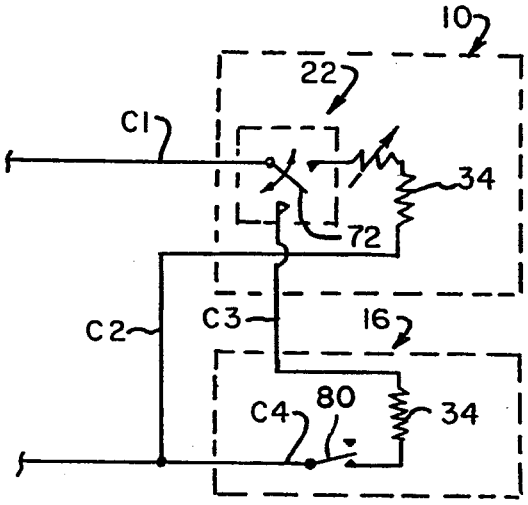

When the water temperature reaches a predetermined, desired temperature, disc 42 snaps to its position shown in FIG. 9B. Movement of the disc moves bumper rod 60 upwardly as shown in the FIG. The upper end of the heating rod contacts face **72*c* of contact 72** and moves contact 72 upwardly away from end 54*b* of the heating rod. This action interrupts the circuit path through the rod 60. At the same time, movement of the bumper rod moves contact face 72*c* into contact with an electrical terminal 68*c* which also is mounted on face 66 of the terminal block. Terminal 68*c* is connected to an electrical conductor C3 which extends from unit 10 to unit 16. As shown in FIG. 10, conductor C3 is connected to one side of the heating rod 34 in unit 16. The other end of the rod 34 in unit 16 is connected as shown in the schematic. Now, current flow to rod 34 in unit 16 is through conductor C1, rod 74, contact 72, terminal 68*c*, and conductor C3.

In operation, a circuit is first established for heater rod 34 in the upper unit 10. The rod heats the water in the tank until the water temperature reaches a level established by the setting of a temperature selector 78 (see FIG. 10) which is used to adjust the bi-metallic disc, or a bi-metallic blade. When the temperature is attained, the operation of disc 42 in the unit causes the circuit to be broken, as described above. As this circuit is interrupted, a circuit to the heater rod 34 in lower unit 16 is established. The heater rod in this lower unit then serves to maintain the water temperature at the desired level. If the water temperatures fall, for example, by an efflux of the heated water and its replacement by cold water, disc 34 in the upper unit will snap back to its original position. Bumper rod 60 will then return to its position in FIG. 9A. This will disrupt the circuit through unit 10 to the heater rod in the lower unit, and re-establish the circuit for the heater rod in the upper unit. Unit 16 includes a switch arm 80 similar to switch arm 72 and operable by a bimetallic disc to open the circuit through the unit when the water temperature in the lower portion of the water heater reaches a desired temperature. This heater will again heat the water to the desired temperature and the switching cycle will be repeated.

What has been described is a heating element for use in water heaters to heat the water to a desired temperature. An adjustable thermostat is combined with the heating element into a single unit which is incorporated in a screw plug that mounts in a sidewall of the water heater. This allows for easier installation and removal of the heating element and thermostat and the integral combination is more energy efficient than if both elements are installed separately. The integral assembly also functions as well as when the elements are used separately. The thermostat senses water temperature by heat conduction through the screw plug. Two screw plug units are employed, one at the upper portion and one at the bottom portion of the water heater. The heating element in the upper unit is initially energized to heat the water to a desired temperature. When the sensed water temperature reaches a desired temperature the thermostat in the upper unit opens the electrical circuit by which electricity is supplied to the heating element in that unit. It also simultaneously closes an electrical circuit by which electricity is supplied to the heating element in the lower unit. This heating element then operates to maintain the water temperature at the desired level.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A combined heating element and thermostat for use in a heater for heating fluid such as water comprising:

an electrical heating element for heating the fluid, the heating element comprising a U-shaped heating rod having a first leg and a second leg, the first leg of said heating rod being longer than the second leg thereof;

mounting means installable in a sidewall of a water heating tank, said heating rod being installed in the mounting means for a portion of said heating rod to be in contact with the fluid when installed in the tank to heat the fluid, an outer end of the respective legs of said heating rods being inserted through respective openings in said mounting means for installing the heating rod in the mounting means;

thermostat means also installed in said mounting means for sensing the fluid temperature and to interrupt heating of the fluid by said heating element when a desired fluid temperature is reached; and, electrical power means by which an electric current is routed through said heating element for the fluid to be heated by said heating elements, said electric power means including an electrical terminal block attached to said mounting means, said terminal block including a first electrical terminal connected with said outer end of the first leg of said heating rod, a second electrical terminal in electrical contact with said outer end of the second leg of said heating rod when said heating rod is heating said fluid, and said electric power means further including switch means for disconnecting said outer end of the second leg of said heating rod from electrical contact with said second electrical terminal, said switch means including a movable, electrically conductive rod having an end electrically contacting said second electrical terminal, a movable electrical contact which is in electrical contact with the other end of said electrically conductive rod, said movable electrical contact being movable between one position in which it is in electrical contact with said outer end of the second leg of said heating rod, whereby said outer end of the second leg is in electrical contact with said second terminal, and another position in which the movable electrical contact is out of contact with said outer end of the second leg of said heating rod to break electrical contact therewith, and the switch means further including bumper means contacted by said thermostat means and movable thereby when the desired fluid temperature is reached, said bumper means contacting said movable electric contact when moved by said thermostat means, for said movable electric contact to move said movable electrically conductive rod away from said inner end of the second leg of said heating rod.

2. The heating element of claim 1 wherein the heater has a heating chamber with a port formed in a sidewall of the chamber, and the mounting means includes a screwplug insertable into a port in the sidewall of a water heater tank.

3. The heating element of claim 2 wherein said screwplug has a central section which is adapted to fit into the port to form an inner "wet" face of said plug to be in fluid contact with the fluid in the chamber, and an outer "dry" face which is external of the chamber, the central section having a bore therein extending inwardly from an outer face of said screwplug substantially through the screwplug and said thermostat means including a thermostat installed in said bore at an inner end thereof so to be adjacent said "wet" face of said screwplug for thermal transfer of heat from the fluid to said thermostat.

4. The heating element of claim 3 wherein spaced opening are formed in said "wet" face of said screwplug and extend into said bore for said legs of said heating rod to be inserted into said screwplug.

5. The heating element of claim 4 wherein the thermostat comprises a bi-metallic disc sized to be received in said bore, said disc having spaced openings therein through which said legs of said heating rod are inserted through said disc when-said heating rod is installed in said screwplug.

6. The heating element of claim 5 wherein said bumper means includes a bumper rod installed in said bore of said screwplug with one end of said bumper rod contacting said disc and the other end of said bumper rod bearing against said movable electric contact, said bumper rod being movable by a snap action of said disc when the fluid temperature reaches a desired temperature, movement of said bumper rod moving said movable electric contact out of contact with said inner end of the second leg of said heating rod to interrupt flow of electricity through said heating rod.

* * * * *